US012667754B2

(12) United States Patent
Miao et al.

(10) Patent No.: US 12,667,754 B2
(45) Date of Patent: Jun. 30, 2026

(54) LIFTING STRUCTURE FOR TREADMILL

(71) Applicant: Yongkang Tiantian Aipao Intelligent Technology Co., Ltd., Jinhua (CN)

(72) Inventors: Qihua Miao, Jinhua (CN); Tiandong Lv, Jinhua (CN); Hui Ye, Jinhua (CN); Qianhai Li, Jinhua (CN); Guangyi Luo, Jinhua (CN); Zhiping Zhou, Jinhua (CN); Bo Huang, Jinhua (CN)

(73) Assignee: Yongkang Tiantian Aipao Intelligent Technology Co., Ltd., Jinhua (CN)

( * ) Notice: Subject to any disclaimer, the term of this patent is extended or adjusted under 35 U.S.C. 154(b) by 94 days.

(21) Appl. No.: 18/399,222

(22) Filed: Dec. 28, 2023

(65) Prior Publication Data

US 2024/0399196 A1 Dec. 5, 2024

(30) Foreign Application Priority Data

Jun. 2, 2023 (CN) ..... 202321391449.6

(51) Int. Cl.
*A63B 22/00* (2006.01)
*A63B 22/02* (2006.01)

(52) U.S. Cl.
CPC ..... *A63B 22/02* (2013.01); *A63B 22/0023* (2013.01)

(58) Field of Classification Search
None
See application file for complete search history.

(56) References Cited

U.S. PATENT DOCUMENTS 4,776,582 A * 10/1988 Ramhorst ..... A63B 22/0023 482/54
5,058,881 A * 10/1991 Measom ..... A63B 22/0023 482/54
5,567,913 A * 10/1996 Lin ..... H02G 3/081 220/3.9
5,607,375 A * 3/1997 Dalebout ..... A63B 22/0023 482/52
5,830,114 A * 11/1998 Halfen ..... A63B 22/0023 482/54
5,897,460 A * 4/1999 McBride ..... A63B 22/02 482/54
6,171,216 B1 * 1/2001 Wang ..... A63B 22/0023 482/54
6,280,362 B1 * 8/2001 Dalebout ..... A63B 22/0228 482/54
6,311,941 B1 * 11/2001 Feldmeyer ..... A47B 97/00 312/351.9

(Continued)

FOREIGN PATENT DOCUMENTS

CN 210228990 U * 4/2020
CN 111714831 A * 9/2020

(Continued)

*Primary Examiner* — Shila Jalalzadeh Abyaneh

(57) ABSTRACT

Disclosed is a lifting structure for a treadmill, including a first unit mounted at a bottom of a treadmill frame and a second unit rotatably connected to the first unit. The first unit includes first walls and second walls, and the second unit includes a third wall and fourth walls, the third wall abutting against the first walls when the second unit is in a folded state, and the fourth walls abutting against the second walls when the second unit is in an unfolded state.

10 Claims, 4 Drawing Sheets

(56) References Cited

U.S. PATENT DOCUMENTS

| | | | | |
|---|---|---|---|---|
| 7,270,306 | B2 * | 9/2007 | Chen | F16M 11/10 248/677 |
| 9,835,284 | B2 * | 12/2017 | Gandole | F16M 7/00 |
| 2002/0183170 | A1 * | 12/2002 | Wu | A63B 71/0054 482/54 |
| 2003/0027691 | A1 * | 2/2003 | Pan | A63B 22/0023 482/54 |
| 2005/0032610 | A1 * | 2/2005 | Nelson | A63B 22/0023 482/54 |
| 2012/0083394 | A1 * | 4/2012 | Gregor | A63B 21/4035 482/121 |
| 2013/0203560 | A1 * | 8/2013 | Wang | A63B 22/0235 482/54 |
| 2013/0231219 | A1 * | 9/2013 | Huang | A63B 22/0023 482/54 |
| 2020/0154877 | A1 * | 5/2020 | Hurley | A47B 3/083 |
| 2023/0349152 | A1 * | 11/2023 | Graves | A63C 19/08 |

FOREIGN PATENT DOCUMENTS

| | | | | |
|---|---|---|---|---|
| DE | 29818870 | U1 * | 12/1999 | A63B 22/0023 |
| KR | 101845310 | B1 * | 4/2018 | A63B 23/0405 |

* cited by examiner

LIFTING STRUCTURE FOR TREADMILL

CROSS-REFERENCE TO RELATED APPLICATIONS

This application claims priority of Chinese Patent Application No. 202321391449.6, filed on Jun. 2, 2023, the entire contents of which are incorporated herein by reference.

TECHNICAL FIELD

The present disclosure relates to the technical field of treadmills, in particular to a lifting structure for a treadmill.

BACKGROUND

The existing treadmill includes a main frame as a base, a treadmill platform mounted on the main frame, armrests and a control platform. The treadmill platform is fixed to the base in parallel to form an exercise plane for walking or running, and when the exercise plane is used, the climbing exercise function can also be realized through a lifting mechanism.

For example, as disclosed in patent document CN112337046A, an inclination angle of the treadmill platform is adjusted by means of bolt fixing to achieve the climbing exercise function. However, in a specific use of the method, the overall weight of the treadmill platform and the user is mainly borne by the bolt. For a long time, the bolt is easily damaged, and the service life of this structure is not long. Therefore, the improvements have been made.

SUMMARY

Aiming at the shortcomings in the prior art, the present disclosure provides a lifting structure for a treadmill.

In order to solve the above technical problems, the present disclosure provides the following technical solutions.

A lifting structure for a treadmill includes a first unit mounted at a bottom of a treadmill frame and a second unit rotatably connected to the first unit. The first unit includes first walls and second walls, and the second unit includes a third wall and fourth walls, the third wall abutting against the first walls when the second unit is in a folded state, and the fourth walls abutting against the second walls when the second unit is in an unfolded state.

In the above solution, preferably, the first unit includes an accommodating groove, and the second unit includes a first portion fitting to the accommodating groove, the first portion being rotatably connected to the first unit.

In the above solution, preferably, a first hole is disposed on the first portion, second holes corresponding to the first hole are disposed at a lower end of the first unit, and the first portion and the lower end of the first unit form a rotating fit through a pin roll penetrating through and arranged in the first hole and the second holes.

In the above solution, preferably, a roll sleeve is assembled in the first hole, and the pin roll is a bolt, one end of the pin roll penetrating through the first portion and the lower end of the first unit, and being threadedly connected to a nut.

In the above solution, preferably, the first unit includes a first side edge having an L-shape, a second side edge having an L-shape, and a third side edge integrally connecting the first side edge and the second side edge.

In the above solution, preferably, the first side edge, the second side edge and the third side edge are integrally formed.

In the above solution, preferably, the second unit includes the first portion having a smaller diameter and the second portion having a larger diameter, and a gap exists between the first side edge and the second side edge for accommodating the first portion.

In the above solution, preferably, the first wall, the second wall, the third wall, and the fourth wall are flat walls.

In the above solution, preferably, the lower end of the first unit has rounded corners; and the second wall, the fourth wall and a bottom surface of the second unit are inclined surfaces.

In the above solution, preferably, the first unit includes an extension wall extending to the lower end of the first unit for limiting the second unit in the unfolded state.

The present disclosure has the following beneficial effects.

The present disclosure has the first unit and the second unit which are rotatably fitted to each other. The treadmill platform is rapidly lifted by rotating the second unit. The two units are surface-to-surface fitted, having good supporting effect, less damage, longer service life and a simpler structure.

DETAILED DESCRIPTION

Figure 1:
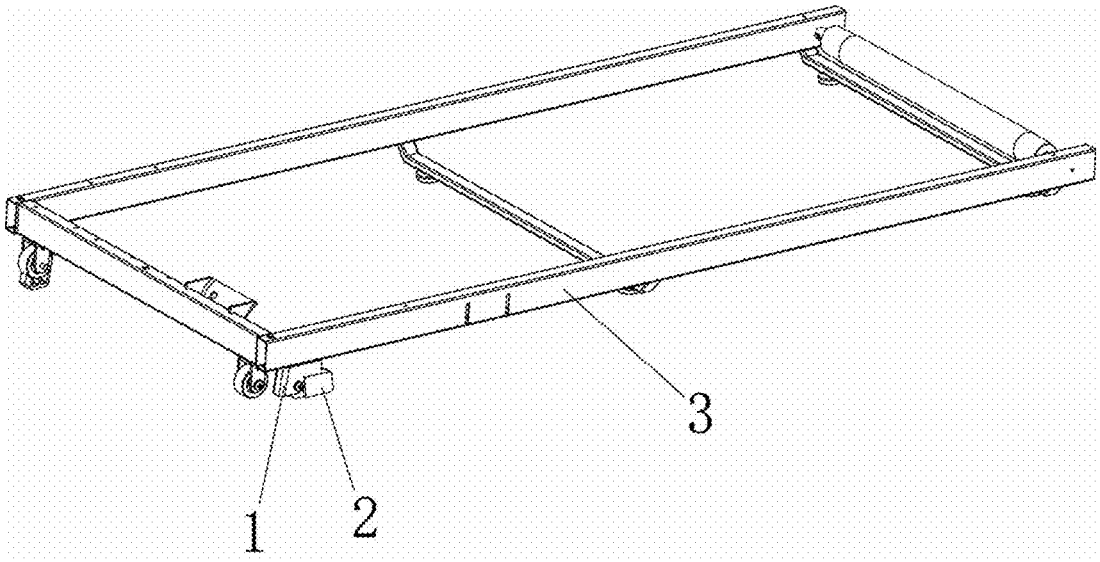
FIG. 1 is a schematic view showing a mounting state of the present disclosure.

The present disclosure will be further described in detail with the attached drawings and specific implementations.

Referring to FIGS. 1-8, a lifting structure for a treadmill includes a first unit 1 and a second unit 2 rotatably fitted thereto, the first unit 1 being fixedly mounted at a bottom of a treadmill frame 3. As one implementation, the first unit 1 is welded to the bottom of the treadmill frame 3.

In the example, the first unit 1 includes a first side edge 11 having an L-shape, a second side edge 12 having an L-shape, and a third side edge 13 integrally connecting the first side edge 11 and the second side edge 12. As an alternative, the first side edge 11, the second side edge 12 and the third side edge 13 are integrally formed.

In the example, an upper wall of the first unit 1 is a flat wall, which is parallel to the bottom of the treadmill frame 3 and closely fits to the bottom of the treadmill frame 3, so that the whole surface can be used to bear the weight of the treadmill frame 3.

Figure 5:
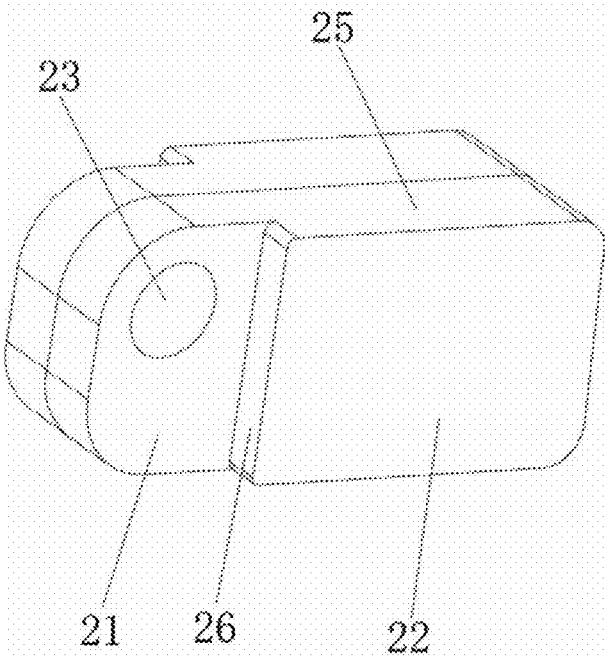
FIG. 5 is a schematic view showing a second unit of the present disclosure.
Figure 6:
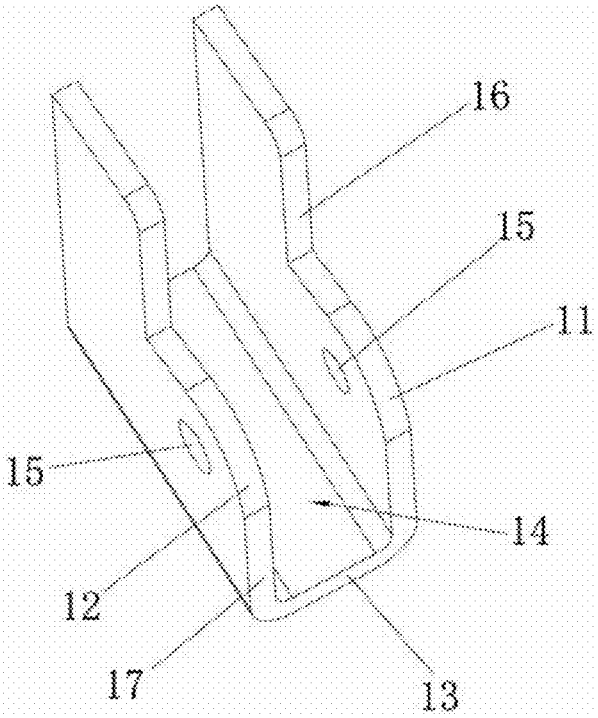
FIG. 6 is a schematic view showing a first unit of the present disclosure.

In the example, as shown in FIG. 5, the second unit 2 includes a first portion 21 having a smaller diameter and a second portion 22 having a larger diameter; and as shown in FIG. 6, in the first unit 1, a gap 14 exists between the first side edge 11 and the second side edge 12 for accommodating the first portion 21.

In the example, a first hole 23 is disposed on the first portion 21 of the second unit 2, and second holes 15 corresponding to the first hole 23 are disposed at a lower end of the first unit 1. Specifically, corresponding second holes 15 are disposed on lower ends of the first side edge 11 and the second side edge 12 to form a through hole with the gap 14 between the first side edge 11 and the second side edge 12.

A pin roll 4 is further included. The pin roll 4 penetrates through one of the second holes 15, then penetrates through the first hole 23 of the first portion 21, and then penetrates through the other second hole 15, so that the first unit 1 and the second unit 2 form a rotating fit.

As an alternative, the pin roll 4, being a bolt, penetrates through and is threadedly connected to a nut.

In order to make the rotation of the second unit 2 more smooth, in the example, a roll sleeve 24 is assembled in the first hole 23, and the pin roll 4 penetrates through and is arranged in the roll sleeve 24.

Figure 2:
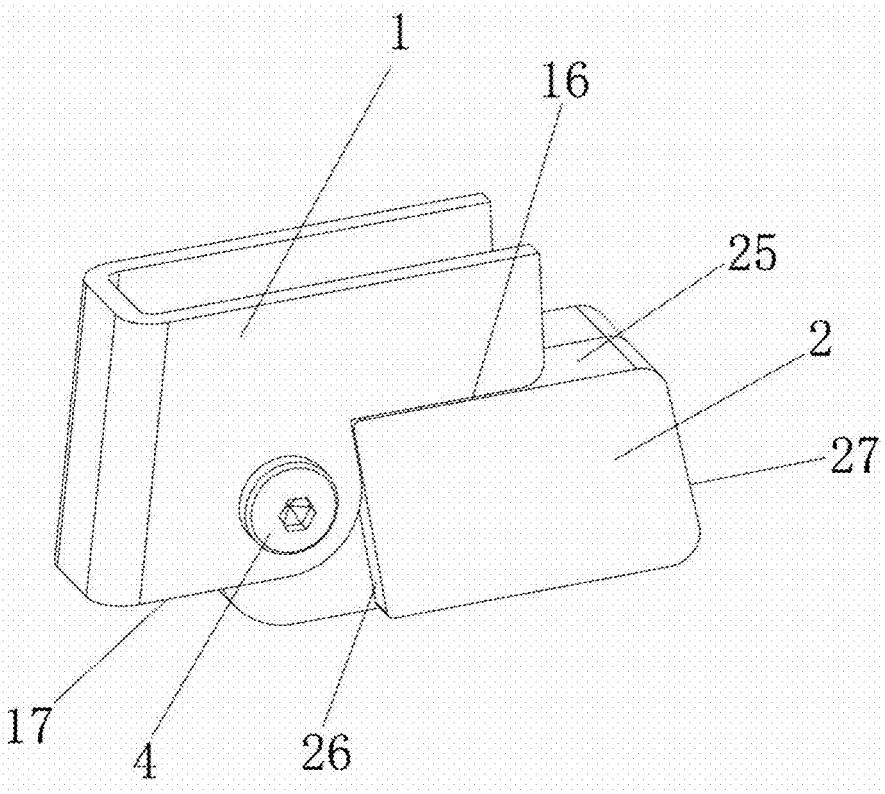
FIG. 2 is a schematic view showing a folded state of the present disclosure.
Figure 3:
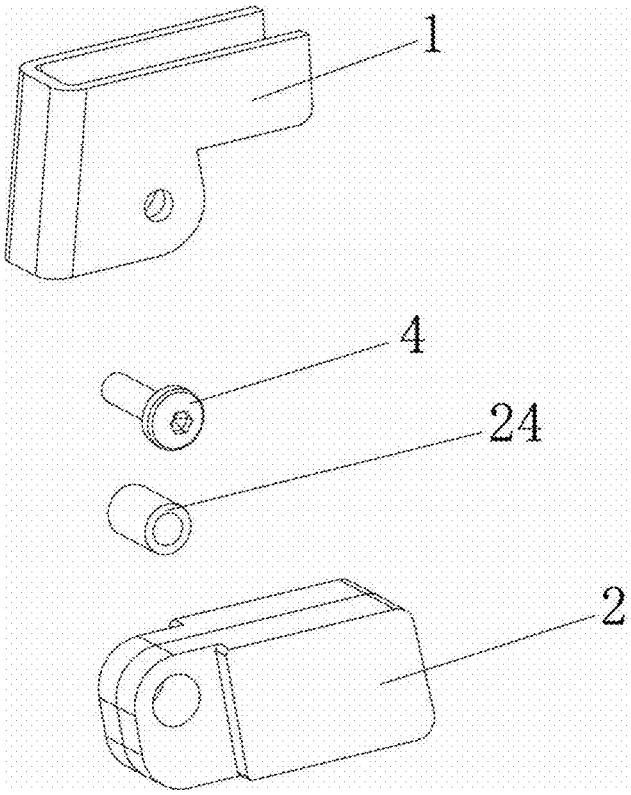
FIG. 3 is a schematic view showing an exploded state of the present disclosure.
Figure 4:
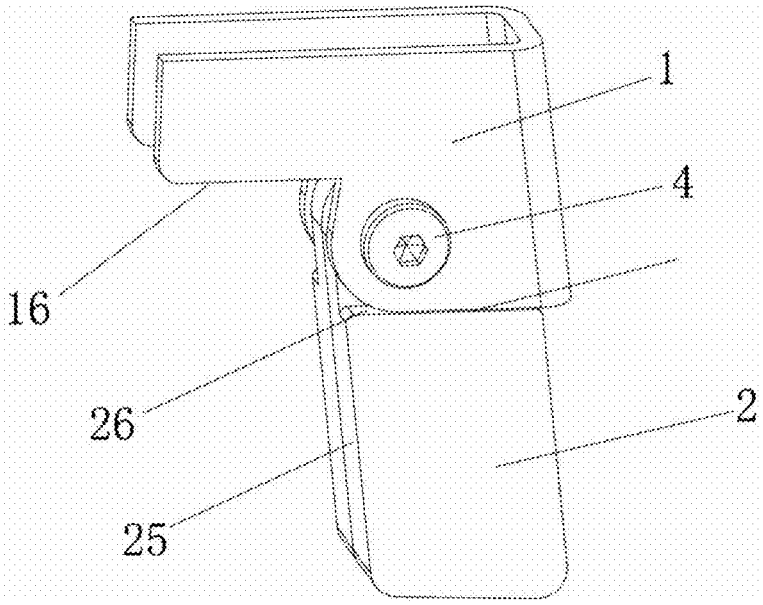
FIG. 4 is a schematic view showing an unfolded state of the present disclosure.

In the example, the second unit 2 has two states: an unfolded state and a folded state, shown in FIG. 2 as the folded state, in which a third wall 25 of the second unit 2 abuts against first walls 16 of the first unit 1, and shown in FIG. 4 as the unfolded state, in which fourth walls 26 of the second unit 2 abut against second walls 17 of the first unit 1.

Specifically, the first wall 16, the second wall 17, the third wall 25, and the fourth wall 26 are flat walls, so that the transmission of force can be effectively guided and the bearing effect is better after the corresponding walls are fitted and abutted.

In order to make the rotating fit between the second unit 2 and the first unit 1 more smooth, in the example, the lower end of the first unit 1 has rounded corners; and the second wall 17, the fourth wall 26 and a bottom surface 27 of the second unit 2 are inclined surfaces.

Figure 7:
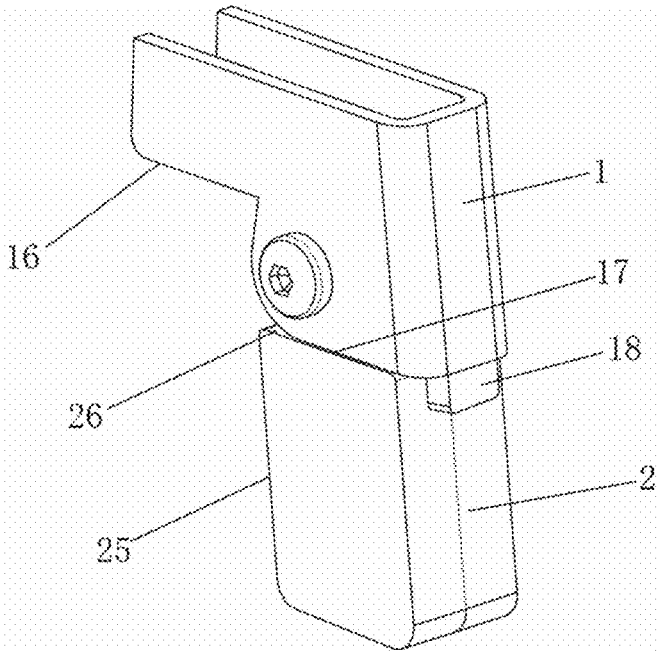
FIG. 7 is a schematic view showing the fitting of the first unit with the second unit of the present disclosure in another form.
Figure 8:
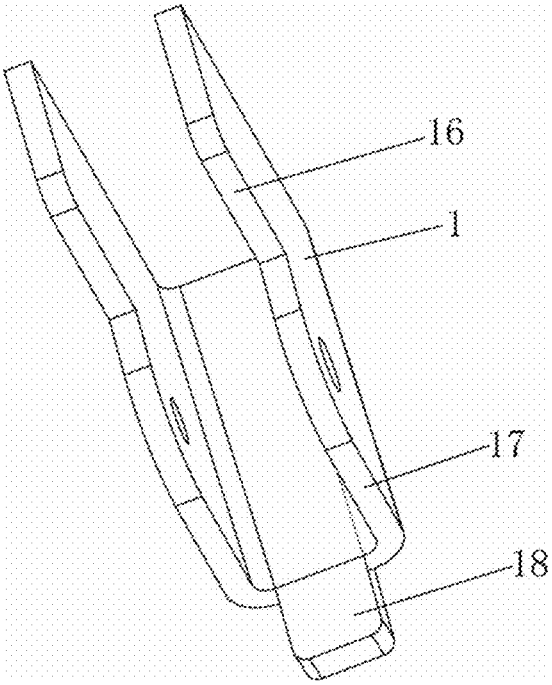
FIG. 8 is a schematic view showing the first unit of the present disclosure in another form.

Referring to FIGS. 7 and 8, another form of the first unit 1 is shown, which differs from the form described above in that: the first unit 1 includes an extension wall 18 extending to the lower end of the first unit 1, the extension wall 18 being capable of limiting the second unit 2 when the second unit 2 is in an unfolded state. At this time, the extension wall 18 abuts against an outer wall of the second unit 2.

As an alternative, an extension wall 18 and the first unit 1 are integrally formed, a width of the extension wall 18 being less than an overall width of the first unit 1.

The above examples are only used to illustrate the technical solutions of the present disclosure, but not to limit this. Although the present disclosure has been described in detail with reference to the foregoing examples, the technical solutions described in the foregoing examples can still be modified, or some technical features can be replaced by equivalents; while these modifications or substitutions do not make the essence of the corresponding technical solutions deviate from the spirit and scope of the technical solutions of various examples of the present disclosure.

The invention claimed is:

1. A lifting structure for a treadmill, comprising:

a first unit mounted at a bottom of a treadmill frame; and a second unit rotatably connected to the first unit, wherein the first unit comprises first walls and second walls, and the second unit comprises a third wall and fourth walls, the third wall abutting against the first walls when the second unit is in a folded state, and the fourth walls abutting against the second walls when the second unit is in an unfolded state, and wherein the first unit further comprises an accommodating groove, and the second unit further comprises a first portion fitting to the accommodating groove, the first portion being rotatably connected to the first unit.

2. The lifting structure for a treadmill according to claim 1, wherein the first unit further comprises a first side edge having an L-shape, a second side edge having an L-shape, and a third side edge integrally connecting the first side edge and the second side edge.

3. The lifting structure for a treadmill according to claim 2, wherein the first side edge, the second side edge and the third side edge are integrally formed.

4. The lifting structure for a treadmill according to claim 3, wherein the second unit further comprises a second portion, the first portion having a smaller diameter and the second portion having a larger diameter, and the accommodating groove exists between the first side edge and the second side edge for accommodating the first portion.

5. The lifting structure for a treadmill according to claim 2, wherein the second unit further comprises a second portion, the first portion having a smaller diameter and the second portion having a larger diameter, and the accommodating groove exists between the first side edge and the second side edge for accommodating the first portion.

6. The lifting structure for a treadmill according to claim 1, wherein a first hole is disposed on the first portion, second holes corresponding to the first hole are disposed at a lower end of the first unit, and the first portion and the lower end of the first unit form a rotating fit through a pin roll penetrating through and arranged in the first hole and the second holes.

7. The lifting structure for a treadmill according to claim 6, wherein a roll sleeve is assembled in the first hole, and the pin roll is a bolt, one end of the pin roll penetrating through the first portion and the lower end of the first unit, and being threadedly connected to a nut.

8. The lifting structure for a treadmill according to claim 1, wherein the first walls, the second walls, the third wall, and the fourth walls are flat walls.

9. The lifting structure for a treadmill according to claim 1, wherein a lower end of the first unit has rounded corners; and the second walls, the fourth walls and a bottom surface of the second unit are inclined surfaces.

10. The lifting structure for a treadmill according to claim 1, wherein the first unit further comprises an extension wall extending to a lower end of the first unit for limiting the second unit in the unfolded state.

* * * * *